US006286156B1

(12) United States Patent
Sullivan

(10) Patent No.: US 6,286,156 B1
(45) Date of Patent: Sep. 11, 2001

(54) MESH SCREEN SWIMMING POOL COVER

(76) Inventor: Thelma Sullivan, 555 Plymouth St., East Bridgewater, MA (US) 02333

( * ) Notice: Subject to any disclaimer, the term of this patent is extended or adjusted under 35 U.S.C. 154(b) by 0 days.

(21) Appl. No.: 09/401,009

(22) Filed: Sep. 21, 1999

(51) Int. Cl.[7] ..... E04H 4/06

(52) U.S. Cl. ..... 4/498; 4/503; 160/187; 160/213; 160/DIG. 130; 160/DIG. 160

(58) Field of Search ..... 4/498, 503, 496, 4/504; 160/DIG. 13, DIG. 16, 185, 187, 213

(56) References Cited

U.S. PATENT DOCUMENTS

| | | | | |
|---|---|---|---|---|
| 2,639,751 | * | 5/1953 | Flaherty | 160/DIG. 16 X |
| 3,016,952 | * | 1/1962 | Shero | 160/DIG. 16 X |
| 3,593,757 | * | 7/1971 | Haynes | 4/498 X |
| 3,683,428 | | 8/1972 | Morris | 4/498 |
| 3,711,873 | * | 1/1973 | Katzman | 4/503 |
| 3,813,704 | * | 6/1974 | Troiano | 4/499 |
| 5,067,182 | | 11/1991 | Koelsch | 4/498 |
| 5,740,562 | * | 4/1998 | Nickalo | 4/503 X |

FOREIGN PATENT DOCUMENTS

| | | | | |
|---|---|---|---|---|
| 2132213 | * | 1/1973 | (DE) | 4/498 |

* cited by examiner

*Primary Examiner*—Gregory L. Huson
*Assistant Examiner*—Kathleen J. Prunner
(74) *Attorney, Agent, or Firm*—Kriegsman & Kriegsman

(57) ABSTRACT

A foldable swimming pool cover includes, in one embodiment, a screen constructed of an ultra-fine, light-weight mesh fabric and a plastic frame mounted on the periphery of the screen. The plastic frame includes a plurality of frame members, each of the frame members having a pair of free ends. The free ends of adjacent frame members are pivotally connected by a bi-directional hinge assembly which enables the swimming pool cover to be collapsed into a vertical stack of individual panels in an accordion fashion. In use, the swimming pool cover is designed to be placed over a swimming pool to prevent environmental debris from falling into and contaminating the water held within the swimming pool. Because the screen is constructed of a mesh fabric, moisture will pass through the screen and environmental debris will accumulate on the screen. In order to use the swimming pool, the swimming pool cover can be folded into a vertical stack of individual panels and lifted off the pool.

1 Claim, 2 Drawing Sheets

MESH SCREEN SWIMMING POOL COVER

BACKGROUND OF THE INVENTION

The present invention relates generally to swimming pool accessories and more particularly to swimming pool covers.

Swimming pool covers are well known in the art and are commonly placed over a swimming pool to prevent environmental debris from falling into and contaminating the water held within the swimming pool.

Most conventional swimming pool covers are manufactured out of a sheet of plastic material which is slightly larger in length and width than the swimming pool over which it is to be disposed. In use, the swimming pool cover is suspended over the desired swimming pool so that the outer periphery of the swimming pool cover rests outside the swimming pool and preferably on a flat surface, such as the top surface of a pool edge or deck. The sheet of plastic material is typically maintained in place over the swimming pool by disposing weighted objects, such as sand bags or water bags, on top of the periphery of the swimming pool cover.

Although widely used in commerce, plastic pool covers of the type described above experience numerous disadvantages.

As a first notable disadvantage, plastic swimming pool covers are typically heavy and bulky, thereby rendering the placement of the swimming pool cover over a swimming pool a time consuming and physically strenuous task. As a consequence, most swimming pool covers are designed to be disposed over a swimming pool for prolonged periods of time, such as an entire winter season, and are not used for frequent (i.e., daily) pool covering applications.

As a second notable disadvantage, plastic swimming pool covers tend to collect large quantities of water over prolonged periods of time. As a consequence, the collected water tends to weigh down the swimming pool cover, thereby making removal of the cover increasingly difficult. In addition, the prolonged collection of a large quantity of water on top of the cover can foster the growth of algae and/or bacteria, which is highly undesirable.

Accordingly, alternative types of swimming pool covers have been introduced to prevent environmental debris from falling into and contaminating the water of a swimming pool.

One alternative type of swimming pool cover which is well known in the art employs a thin, lightweight, flexible plastic sheet. However, it has been found, that thin plastic sheets tend to become rapidly embrittled by the sun and/or pool chemicals. As a result, the swimming pool cover is prone to tearing, which is undesirable.

Another alternative type of swimming pool cover which is well known in the art employs rows of insulative, buoyant, foam panels which are hinged together at their adjacent ends by hinge means.

In U.S. Pat. No. 5,067,182, to L.M. Koelsch, there is disclosed a modular floating swimming pool cover which includes a series of buoyant panels which are hinged together to form a row of panels. The cover can include several adjacent rows. The hinge includes spaced hinge links which fit into slots in the panel ends allowing alternate direction or accordion folding for vertical stack storage and ease in swinging into a use position floating on the liquid surface of the pool.

In U.S. Pat. No. 3,683,428 to L. Morris, there are disclosed a rigid, buoyant, insulating and rapid folding swimming pool covers. Rigid, closed cell foam plastic sheets are joined by flexible hinges. A series of resulting strips are floated, side by side, to cover the pool. Overall dimensions are slightly smaller than the inner pool perimeter to allow for easy removal. There is attached to the outer perimeter and extending past the edge of the sheets and up the wall of the pool, a flexible lip, preferably porous, so that some pressure is exerted to keep individual sections together while sealing the open perimeter channel. This allows rain water passage to the pool below without permitting dirt to follow. Flexible or elastomeric inserts are attached at comers and at necessary breaks in the lip selected for folding or closer fitting to further keep out contamination. The alternatively hinged, rigid foam sheets fold, accordion like, into a small space when not in use.

Swimming pool covers which use rows or insulative, buoyant, foam panels are lightweight and easy to manipulate. However, swimming pool covers of this type experience a couple notable drawbacks.

As a first drawback, this type of swimming pool cover typically rests on the top surface of the water of the swimming pool and is not securely fastened to a fixed structure, such as a pool edge or deck, by weighted devices. As a consequence, this type of swimming pool cover could become partially or fully displaced off of the swimming pool during a storm or other similar condition, which is undesirable.

As a second drawback, this type of swimming pool cover tends to allow the accumulation of some water thereon, thereby weighing down the cover and fostering algae growth, which is undesirable.

SUMMARY OF THE INVENTION

It is an object of this invention to provide a new and improved swimming pool cover.

It is another object of this invention to provide a swimming pool cover as described above which can be securely disposed over a swimming pool in order to prevent environmental debris from falling into and contaminating the water of the swimming pool and animals and rodents from entering the pool.

It is yet another object of this invention to provide a swimming pool cover as described above which highly portable.

It is still another object of this invention to provide a swimming pool cover as described above which does not collect water thereon.

It is another object of this invention to provide a swimming pool cover as described above which has a limited number of parts, which is easy to use and which is inexpensive to manufacture.

Accordingly, in one embodiment of the present invention, there is provided a swimming pool cover comprising a screen, and a frame mounted on said screen.

In another embodiment of the present invention, there is provided a swimming pool cover comprising a screen and at least one attachment device mounted on at least a portion of the periphery of said screen.

It should be noted that the screen of this invention is intended to be placed over the pool after it has been cleaned of all unwanted matter and then removed when the pool is to be used.

Various other features and advantages will appear from the description to follow. In the description, reference is made to the accompanying drawings which form a part thereof, and in which is shown by way of illustration, specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF THE PREFERRED EMBODIMENT

Figure 1:
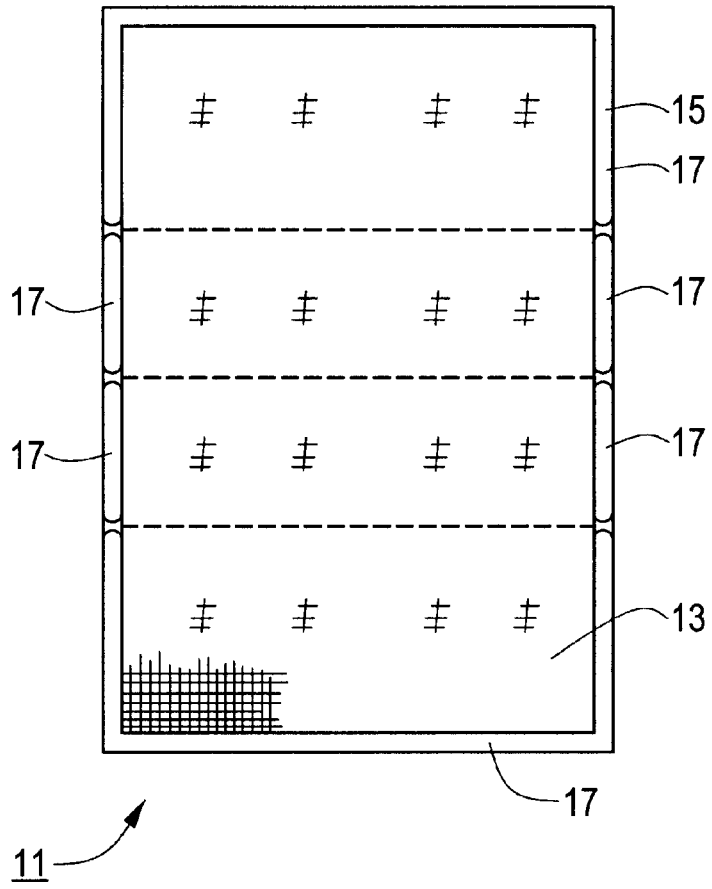
FIG. 1 is a top plan view of a first embodiment of a swimming pool cover constructed according to the teachings of the present invention.
Figure 2:
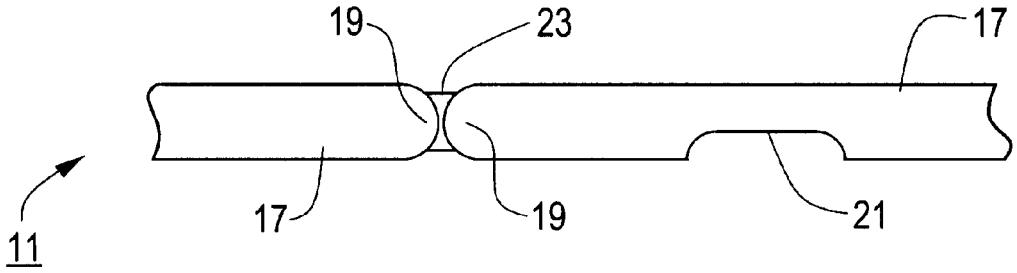
FIG. 2 is an enlarged, fragmentary, side view of two panels of the swimming pool cover shown in FIG. 1.
Figure 3:
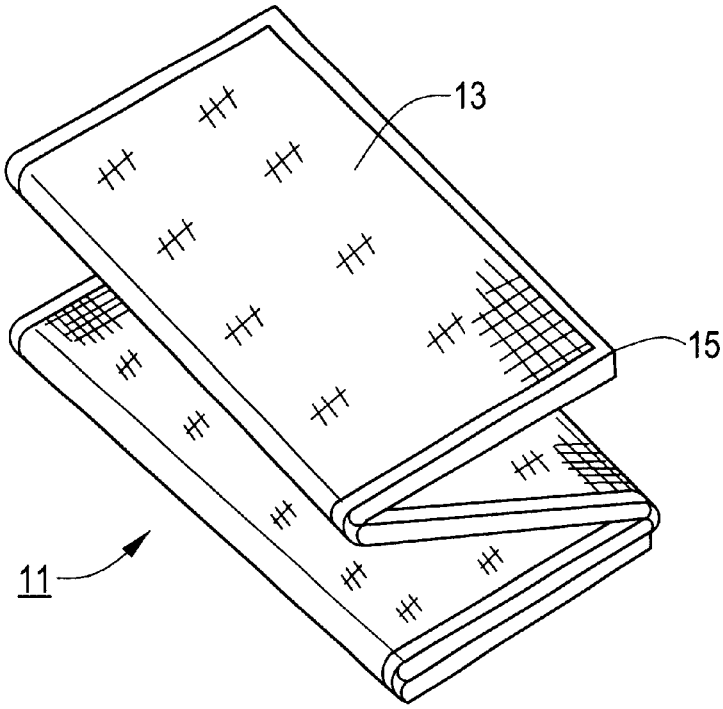
FIG. 3 is a perspective view of the swimming pool cover shown in FIG. 1, the swimming pool cover being shown is a partially folded position.

Referring now to FIGS. 1–3, there is shown a first embodiment of a swimming pool cover constructed in accordance with the principles of the present invention, the swimming pool cover being designated as reference numeral 11. As can be appreciated, cover 11 can be placed over a swimming pool to prevent environmental debris from falling into and contaminating the water held within the swimming pool as well as animals and rodents from entering the pool.

Swimming pool cover 11 comprises a screen 13 and a frame 15 attached to the periphery of screen 13.

Screen 13 is preferably constructed of a generally rectangular, ultra-fine, lightweight mesh fabric which has an ultraviolet protective coating applied thereto to protect screen 13 from harsh elements, such as sunlight and/or chemical deterioration. Screen 13 also preferably comprises a bottom surface (not shown) which is coated with a light restrictive color, such as black, in order to prevent algae and bacterial growth.

It should be noted that because screen 13 is manufactured out of a mesh fabric, moisture, such as rain or mist, will pass through screen 13, whereas environmental debris, such as leaves and bugs, will accumulate on screen 13 and animals and rodents will be prevented from entering the pool.

Frame 15 comprises a plurality of frame members 17 which are preferably constructed out of a rigid material, such as plastic, each frame member 17 comprising a pair of free ends 19. One or more frame members 17 may be shaped to include a grooved recess 21 which serves as a gripping surface for handling swimming pool cover 11.

Adjacent free ends 19 of frame members 17 are pivotally mounted together by a hinge assembly 23 which enables frame members 17 to pivot in either direction until adjacent frame members 17 are in contact, as will be described in further detail below. Hinge assembly 23 represents any bi-directional hinge assembly which is well known in the art. For example, hinge assembly 23 could be in the form of a hinge bracket pivotally mounted onto free ends 19 of adjacent frame members 17 by one or more pins, rods, or other similar devices.

In use, swimming pool cover 11 functions in the following manner. Swimming pool cover 11 is unfolded and disposed over a swimming pool to prevent environmental debris from falling into and contaminating the water held within the swimming pool and also to prevent animals and rodents from entering the pool. Preferably, swimming pool cover 11 is sized and shaped so that frame 15 lies outside the swimming pool and on a flat surface, such as the top surface of a pool edge or deck. In addition, frame 15 of swimming pool cover 11 is preferably weighted at its comers in order to secure swimming pool cover 11 down over the swimming pool during unfavorable conditions, such as wind.

As noted above, because screen 13 is manufactured out of an ultra-fine mesh fabric, swimming pool cover 11 effectively filters out environmental debris, such as leaves, insects, animals and rodents, but allows for moisture to pass therethrough into the swimming pool, thereby preventing the accumulation of water on swimming pool cover 11, which is an object of the present invention.

Swimming pool cover 11 can be easily removed from the swimming pool. Specifically, hinge assemblies 23 enable frame members 17 of frame 15 to be folded in one direction and then in the opposite direction in an accordion fashion. Because screen 13 is manufactured out of an ultra-fine mesh fabric, screen 13 can also be folded into a vertical stack of individual panels, as shown in FIG. 3. With swimming pool cover 11 folded into a vertical stack of individual panels, grooved recess 21 can be used as a gripping surface for lifting swimming pool cover 11 off of the swimming pool. Because swimming pool cover 11 can be folded, or collapsed, into a vertical stack of individual panels, cover 11 can be easily stored until further use.

It should be noted that although swimming pool cover 11 is shown comprising four panels, swimming pool cover 11 could comprise alternative numbers of panels to accommodate different sized swimming pools without departing from the spirit of the present invention.

It should also be noted that swimming pool cover 11 could be sized and shaped to be custom fit over a particular swimming pool or swimming pool cover 11 could be of a standard size and shape to accommodate most conventional sized swimming pools.

Figure 4:
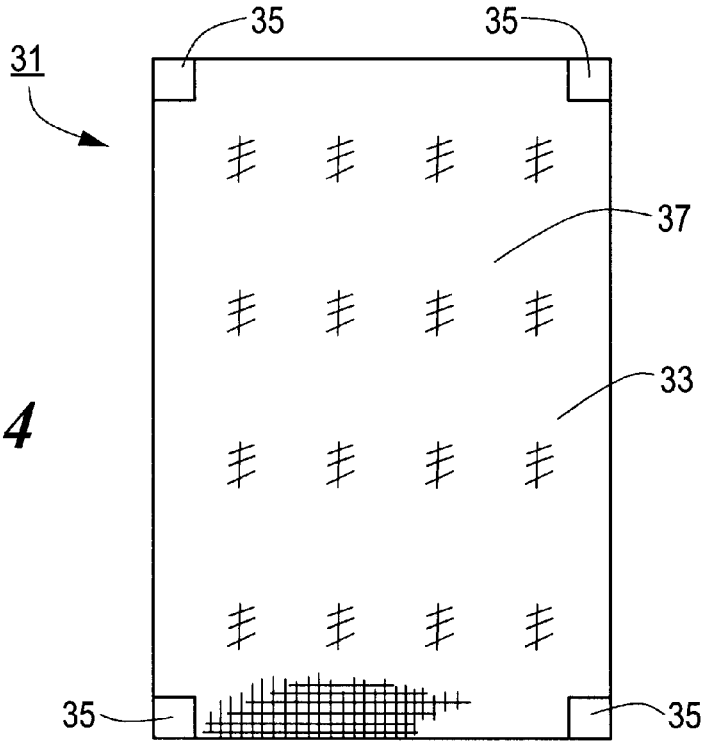
FIG. 4 is a bottom plan view of a second embodiment of a swimming pool cover constructed according to the teachings of the present invention.

Referring now to FIG. 4, there is shown a second embodiment of a swimming pool cover constructed in accordance with the principles of the present invention, the swimming pool cover being designated as reference numeral 31.

Swimming pool cover 31 comprises a screen 33 and a plurality of attachment devices 35 mounted on screen 33.

Screen 33 is identical to screen 13 of swimming pool cover 11. Specifically, screen 33 is preferably constructed of a generally rectangular, ultra-fine, lightweight mesh fabric which has an ultraviolet protective coating applied thereto to protect screen 33 from harsh elements, such as sunlight and/or chemical deterioration. Screen 33 also preferably comprises a bottom surface 37 which is coated with a light restrictive color, such as black, in order to prevent algae and bacterial growth.

Attachment devices 35 are mounted on bottom surface 37 of mesh screen 33 along its periphery. Preferably, one attachment device 35 is mounted on bottom surface 37 at each corner of mesh screen 33.

Each attachment device 35 is shown in FIG. 4 as being in the form of a magnet which is adapted to releasably fasten onto an associated magnet (not shown) which is mounted onto a flat surface in the immediate pool area, such as the top surface of a pool edge or desk, so as to securely fasten said swimming pool cover 31 down over the swimming pool and onto the flat surface. However, it is to be understood that attachment devices 35 represent any attachment device which can be used to securely fasten swimming pool cover 31 down over a swimming pool and onto a flat surface in the immediate pool area, such as the top surface of a pool edge or deck. As an example, attachment device 35 may be a suction device which fastens onto the flat surface around the pool or, in the alternative, may be a suction device which fastens onto a complimentary suction device which is mounted onto the flat surface around the pool.

The embodiments shown of the present invention are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A swimming pool cover for a generally rectangular swimming pool, said swimming pool cover comprising:

a. a generally rectangular frame sized to fit over said generally rectangular swimming pool, and b. an ultra-fine, lightweight, mesh fabric, foldable screen within said generally rectangular frame and attached to said generally rectangular frame, c. said generally rectangular frame having no internal frame structures extending across said screen and defining an external peripheral frame extending over said generally rectangular swimming pool, said generally rectangular frame comprising a plurality of frame members hingedly interconnected to one another such that the swimming pool cover can be collapsed into a stack of individual panels in an accordion fashion.

* * * * *